US007882887B2

(12) United States Patent
Wagstaff et al.

(10) Patent No.: US 7,882,887 B2
(45) Date of Patent: Feb. 8, 2011

(54) SEQUENTIAL CASTING OF METALS HAVING THE SAME OR SIMILAR CO-EFFICIENTS OF CONTRACTION

(75) Inventors: Robert Bruce Wagstaff, Spokane Valley, WA (US); Todd F. Bischoff, Spokane Valley, WA (US)

(73) Assignee: Novelis Inc., Toronto (CA)

( * ) Notice: Subject to any disclaimer, the term of this patent is extended or adjusted under 35 U.S.C. 154(b) by 271 days.

(21) Appl. No.: 12/220,954

(22) Filed: Jul. 29, 2008

(65) Prior Publication Data

US 2009/0056904 A1 Mar. 5, 2009

Related U.S. Application Data

(60) Provisional application No. 60/966,603, filed on Aug. 29, 2007.

(51) Int. Cl.
*B22D 11/00* (2006.01)

(52) U.S. Cl. ..... 164/461

(58) Field of Classification Search ..... 164/461
See application file for complete search history.

(56) References Cited

U.S. PATENT DOCUMENTS 4,724,896 A 2/1988 Rose et al.
6,260,602 B1 7/2001 Wagstaff
2005/0011630 A1 1/2005 Anderson et al.
2007/0215312 A1 9/2007 Gallerneault
2007/0215313 A1 9/2007 Wagstaff
2008/0008903 A1 1/2008 Bull et al.
2008/0202720 A1 8/2008 Wagstaff
2009/0288795 A1 11/2009 Bischoff et al.

*Primary Examiner*—Kuang Y Lin
*Assistant Examiner*—Nicholas P D'Aniello
(74) *Attorney, Agent, or Firm*—Cooper & Dunham LLP

(57) ABSTRACT

A method and apparatus is disclosed for casting metals in a DC mold to form an ingot or product having at least two layers formed by sequential solidification. The apparatus has at least one cooled divider wall at the entry end portion of the mold to divide the entry end portion into at least two feed chambers. Metal is fed to the chambers to form an inner layer and at least one outer layer. The divider wall has a metal-contacting surface for contacting the metal for the at least one outer layer, the surface being arranged at an angle sloping away from the metal for the outer layer in a downward direction. The angle is larger at the center of the divider wall compared to the angle adjacent to each longitudinal end thereof. The apparatus is suitable for co-casting metals having similar coefficients of contraction to minimize problems of adhesion between the layers of a resulting ingot or rolled products produced therefrom.

9 Claims, 6 Drawing Sheets

SEQUENTIAL CASTING OF METALS HAVING THE SAME OR SIMILAR CO-EFFICIENTS OF CONTRACTION

CROSS-REFERENCE TO RELATED APPLICATIONS

This application claims the priority right of U.S. provisional patent application Ser. No. 60/966,603 filed Aug. 29, 2007 by applicants named herein.

BACKGROUND OF THE INVENTION (1) Field of the Invention

This invention relates to the casting of metals, particularly aluminum and aluminum alloys, by direct chill (DC) casting techniques. More particularly, the invention relates to the co-casting of metal layers by direct chill casting involving sequential solidification.

(2) Description of the Related Art

Metal ingots are commonly produced by direct chill casting of molten metals. This involves pouring a molten metal into a mold having cooled walls, an open upper end and (after start-up) an open lower end. Molten metal is introduced into the mold at the open upper end and is cooled and solidified (at least externally) as it passes through the mold. Solidified metal in the form of an ingot emerges from the open lower end of the mold and descends as the casting operation proceeds. In other cases, the casting takes place horizontally, but the procedure is essentially the same. Such casting techniques are particularly suited for the casting of aluminum and aluminum alloys, but may be employed for other metals too.

DC casting techniques of this kind are discussed extensively in U.S. Pat. No. 6,260,602 to Wagstaff, which relates exclusively to the casting of monolithic ingots, i.e. ingots made of the same metal throughout and cast as a single layer. Apparatus and methods for casting layered structures by sequential solidification techniques are disclosed in U.S. Patent Publication No. 2005/0011630 A1 to Anderson et al. Sequential solidification involves the casting of a first layer and then, subsequently but in the same casting operation; casting a layer of other metals on the first layer once it has achieved a suitable degree of solidification. Variations include casting outer layers of a multi-layer ingot first, and then casting a core layer within the outer layers once the outer layers have solidified suitably.

While these techniques are effective and successful, it has been found by the inventor of the present invention that difficulties may be encountered when attempting to employ the sequential solidification technique with certain combinations of alloys, particularly those having the same or very similar coefficients of contraction upon solidification and cooling. In particular, when such metals are sequentially cast, it has been found that the cladding layer may not bond as securely with the core layer as would be desired, particularly in the center region of the composite ingot.

There is therefore a need for improved casting equipment and techniques when co-casting metals of these kinds.

BRIEF SUMMARY OF THE INVENTION

One exemplary embodiment provides apparatus for casting a composite metal ingot. The apparatus comprises an open-ended generally rectangular mold cavity having an entry end portion, a discharge end opening, and a movable bottom block adapted to fit within the discharge end and to move axially of the mold during casting. At least one cooled divider wall is provided at the entry end portion of the mold to divide the entry end portion into at least two feed chambers. The apparatus includes a feeder for feeding metal for an inner layer to one of the at least two feed chambers and at least one additional feeder for feeding metal for at least one outer layer to at least one other of the feed chambers. The at least one divider wall has a metal-contacting surface that in use contacts the metal of the at least one outer layer, the surface being arranged at an angle sloping away from the metal of the outer layer in a direction of metal flow through the mold, the angle being larger at a center of the at least one divider wall than at positions adjacent to longitudinal ends of the at least one divider wall.

Another exemplary embodiment provides a method of casting a composite ingot, comprising the steps of: providing an apparatus for casting a composite metal ingot, the apparatus including an open-ended generally rectangular mold cavity having an entry end portion, a discharge end opening, and a movable bottom block adapted to fit within the discharge end and to move axially of the mold during casting, at least one cooled divider wall at the entry end portion of the mold to divide the entry end portion into at least two feed chambers, and a feeder for feeding metal for an inner layer to one of the at least two feed chambers and at least one additional feeder for feeding metal for at least one outer layer to at least one other of the feed chambers, wherein the at least one divider wall has a metal-contacting surface in use contacting the metal of the at least one outer layer, the surface being arranged at an angle sloping away from the metal of the outer layer in a direction of metal flow through the mold, and the angle being larger at a center of the at least one divider wall than at positions adjacent to longitudinal ends of the at least one divider wall; feeding metal for an inner layer to one of the at least two feed chambers; feeding a metal for at least one outer layer to at least one other of the feed chambers, wherein the metal for the inner layer and the metal for the at least one outer layer are chosen to have the same or similar coefficients of contraction; and moving the bottom block axially of the mold to allow an ingot to emerge from the discharge end opening of the apparatus.

Yet another exemplary embodiment provides, in a method of casting an inner layer made of a metal and at least one metal cladding layer of another metal in a direct chill casting apparatus having at least one divider wall forming at least two chambers in the apparatus, wherein the metal for the inner layer and the metal of the at least one outer layer are chosen to have the same or similar coefficients of contraction, an improvement which comprises angling the at least one divider wall at an angle sloping outwardly in a downward direction away from metal supplied for the at least one outer layer, and increasing the angle at a center of the at least one divider wall relative to the angle at positions on the at least one divider wall adjacent to longitudinal ends thereof.

It is not really understood why the co-casting of metals of similar coefficients of contraction can cause adherence problems between the resulting metal layers, but this has been observed empirically by the inventors of the present invention.

Coefficients of contraction of metals and alloys are generally well known and readily available from reference works as they are considered to be one of the essential properties that need to be known for various uses of the metals. Comparisons of the coefficients, and calculation of their percentage differences, can therefore easily be made for specified metal combinations by simple arithmetical means.

The term "similar coefficients of contraction" as used herein means that the coefficients of the alloys differ by less than 30%. There appears to be little or no benefit from the use of the present invention when the difference of the coefficients is 30% or more. In many cases, the relevant differences of the coefficients for advantageous use with the present invention are less than 25%, less than 20%, less than 15% and, most commonly, less than 10%.

It should be appreciated that the term "rectangular" as used in the claims and description of this specification is meant to include the term "square", and that terms such as up and down (upwardly and downwardly) relate to examples involving vertical casting techniques and should be modified appropriately when considering horizontal casting techniques.

By the term "at an angle sloping away from the metal for the outer layer" and similar terminology used in this specification, it is meant that the surface of the divider wall that contacts metal intended for an outer layer of a cast ingot slopes or tapers towards the inner layer of the ingot, and thus away from the outer layer, in the direction of casting, i.e. the direction of flow of metal through the mold.

DETAILED DESCRIPTION OF THE EXEMPLARY EMBODIMENTS

The present invention may employ or be used with casting apparatus of the type described, for example, in U.S. Patent Publication No. 2005/0011630, published on Jan. 20, 2005 in the name of Anderson et al. (the disclosure of which is incorporated herein by reference). This apparatus makes it possible to cast metals by sequential solidification to form at least one outer layer (e.g. a cladding layer) on an inner layer (e.g. a core layer or ingot). The invention also employs and extends techniques disclosed in U.S. Pat. No. 6,260,602 to Wagstaff (the disclosure of which is also incorporated herein by reference).

It should be explained that the terms "outer" and "inner" are used herein quite loosely. For example, in a two-layer structure, there may strictly speaking be no outer layer or inner layer as such, but an outer layer is normally considered to be one that is intended to be exposed to the atmosphere, to the weather or to the eye when fabricated into a final product. Also, the "outer" layer is often thinner than the "inner" layer, usually considerably so, and is thus provided as a thin coating layer or cladding on the underlying "inner" layer or core ingot. In the case of ingots intended for hot and/or cold rolling to form sheet articles, it is often desirable to coat both major (rolling) faces of the ingot, in which case there are certainly recognizable "inner" and "outer" layers. In such circumstances, the inner layer is often referred to as a "core" or "core ingot" and the outer layers are referred to as "cladding layers" or "cladding".

Figure 1:
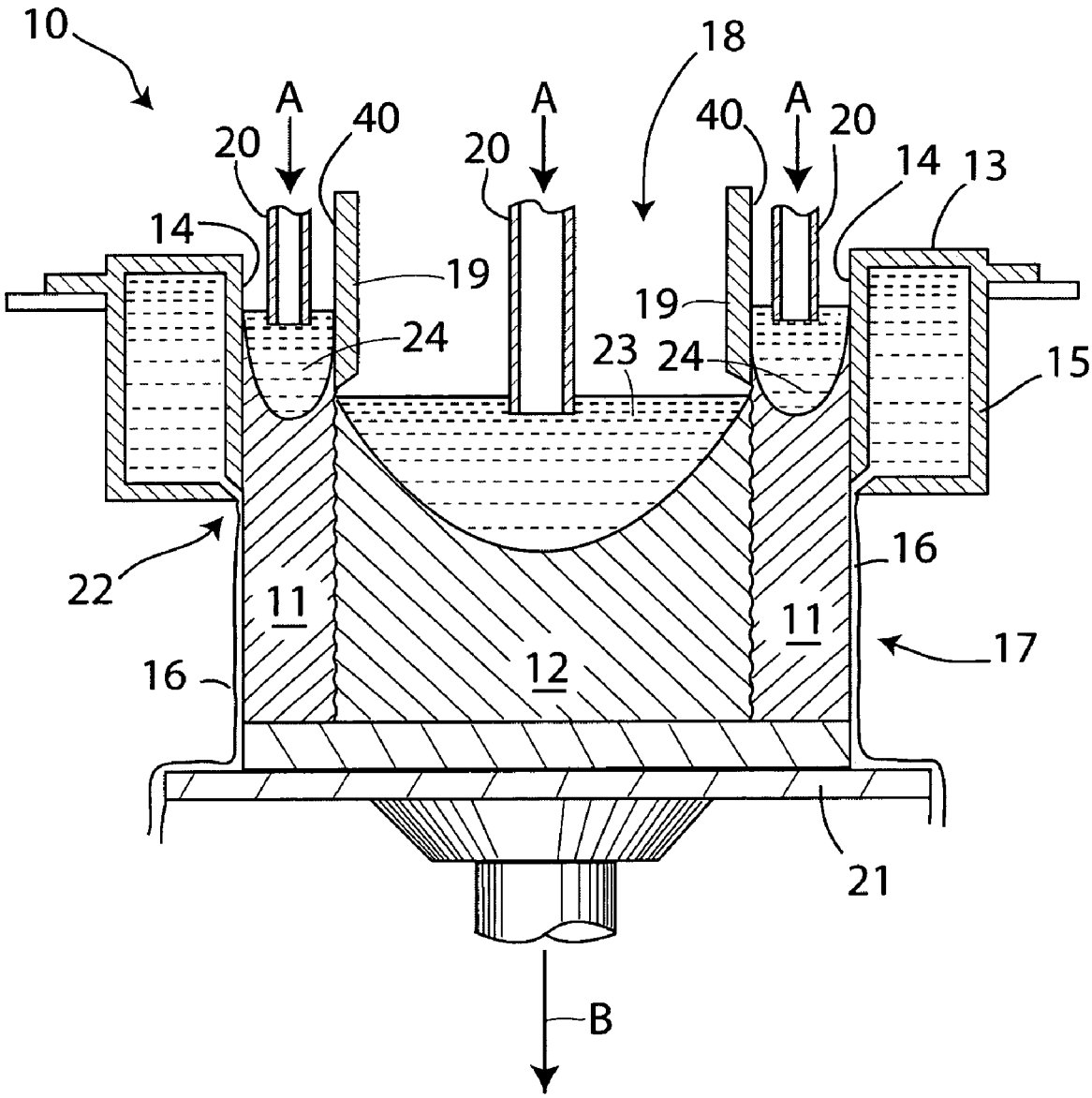
FIG. 1 is a vertical cross-section of a proposed casting apparatus suitable for use with exemplary embodiments of the present invention.

FIG. 1 shows a proposed casting apparatus 10, based on concepts disclosed in Anderson et al., that is used for casting an outer layer 11 on both major surfaces (rolling faces) of a rectangular inner layer or core ingot 12. It will be noticed that, in this version of the apparatus, the coating layers are solidified first during casting (at least partially) and then the core layer 12 is cast in contact with the coating layers. The exemplary embodiments relate primarily to this kind of configuration. The apparatus includes a generally rectangular casting mold assembly 13 that has mold walls 14 forming part of a water jacket 15 from which a peripheral stream 16 of cooling water is dispensed onto an emerging ingot 17. Ingots cast in this way generally are of rectangular cross-section and normally have a size of up to 70 inches by 35 inches. They are often used for rolling into clad sheet in a rolling mill by conventional hot and cold rolling procedures. It should be noted that the mold walls 14 may, in some embodiments, be bowed slightly outwardly at the centers (when considered in plan view) to allow for contraction of the ingot as it cools, thereby imparting to the cooled ingot a more precise rectangular shape.

An entry end portion 18 of the mold is separated by two divider walls 19 (sometimes referred to as "chills" or "chill walls") into three feed chambers, one for each layer of the ingot structure. The divider walls 19, which are often made of copper for good thermal conductivity, are kept cool by means of water chilled cooling equipment (not shown) contacting the divider walls at positions above the molten metal levels. Consequently, the divider walls cool and eventually solidify the molten metal that comes into contact with them. As represented by the arrows A, each of the three chambers is supplied with molten metal up to a desired level via separate molten metal delivery nozzles 20 equipped with an adjustable throttle (not shown) to maintain a constant surface height of metal in the respective feed chambers. The metal 24 chosen for the outer layers 11 is usually different from the metal 23 of the core 12, although this need not always be the case as it is sometimes desirable to co-cast separate layers of the same metal. A vertically movable bottom block unit 21 initially closes an open bottom end 22 of the mold, and is then lowered during casting (as indicated by the arrow B) while supporting the embryonic composite ingot 17 as it emerges from the mold.

Figure 2:
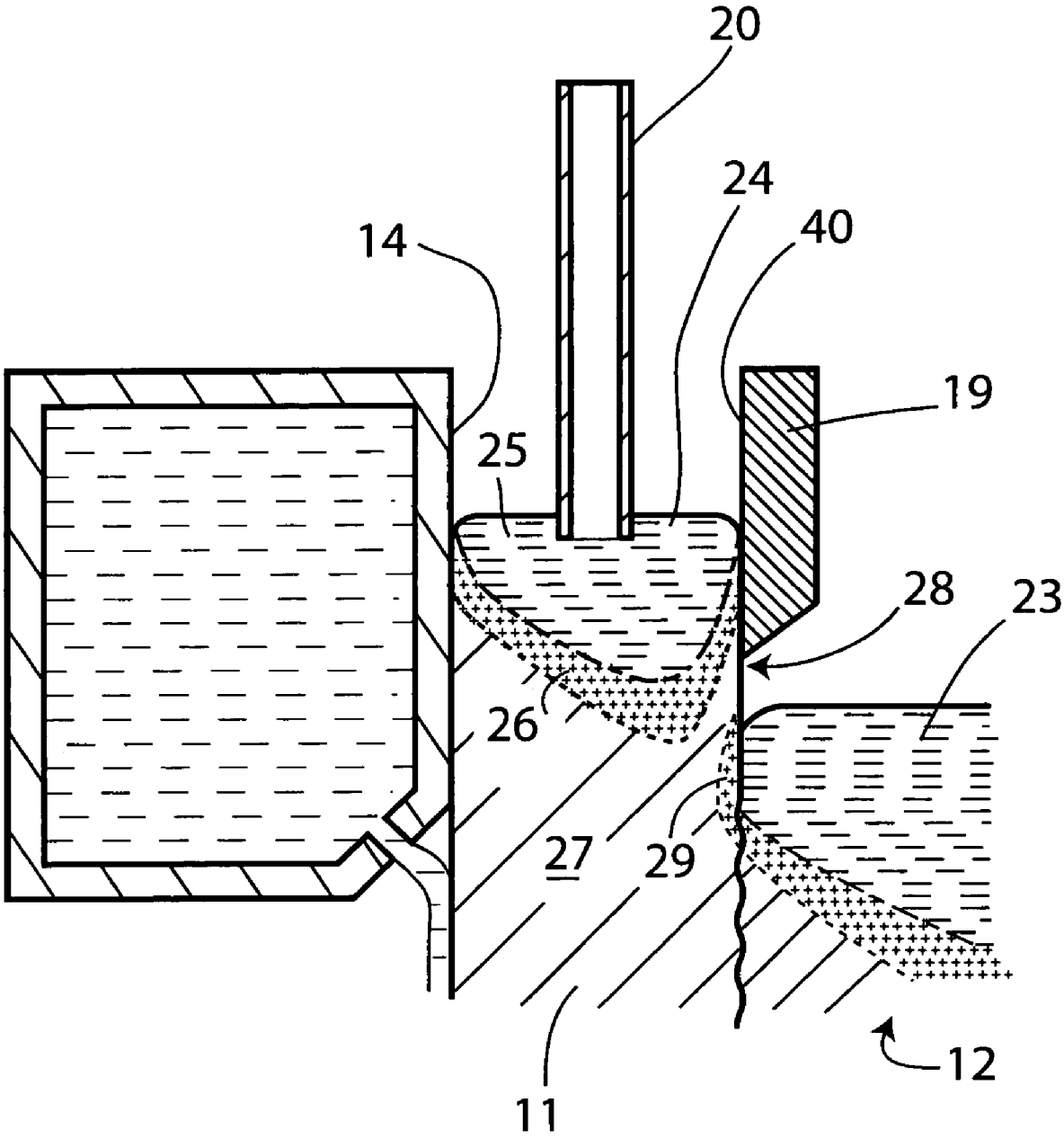
FIG. 2 is a schematic illustration of a region of contact between metal alloys in part of the apparatus of FIG. 1 showing regions of solid, liquid and semi-solid metals as they are believed by the inventor to occur during casting.
Figures 3A, 3B, 3C, 3D:
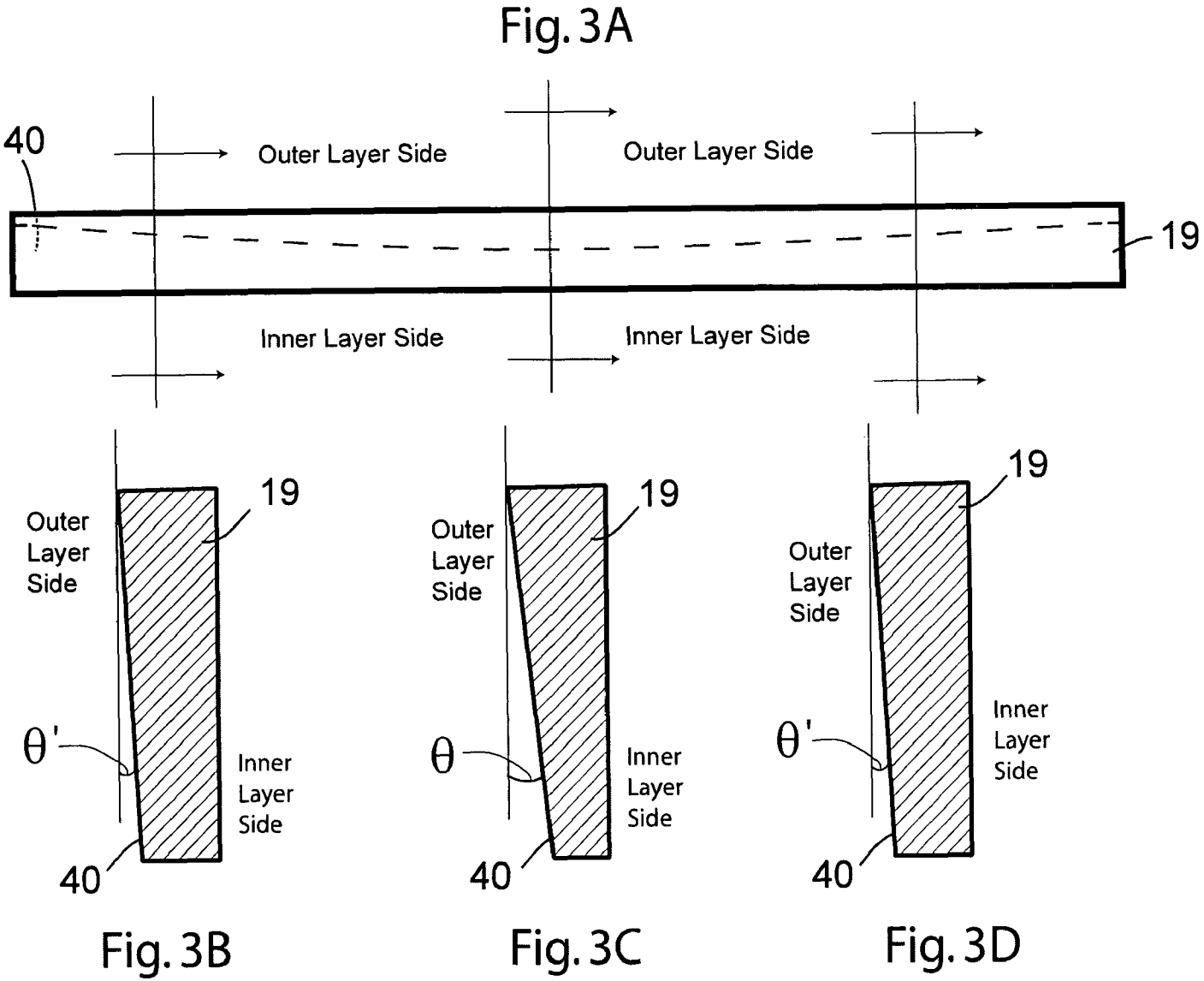
FIGS. 3A to 3D are drawings illustrating one form of a divider wall used in apparatus of the type shown in FIG. 1, the divider wall being shown in perspective and illustrative cross-sections.

FIG. 2 is an enlargement of the region of the apparatus of FIG. 1 adjacent to the left hand divider wall 19 where the metal 23 of the core layer 12 and the metal 24 of the left hand cladding layer 11 come into mutual contact in (or in some cases below) the mold. Metal alloys, when transitioning from the liquid state to solid state, go through an intermediate semi-solid or "mushy" state when the temperature of the metal lies between the liquidus temperature and the solidus temperature of the metal. concerned. The metal 24 forming the cladding layer 11 has a molten sump region 25 (i.e. a pool of molten metal), a semi-solid or mushy zone 26 below and around the molten sump, and a fully solid region 27 generally below the mushy zone, and these regions are contoured much in the manner shown due to the cooling effects of the mold wall 14 and the divider wall 19. It is theorized that surface 28 of the cladding layer 11 immediately below the cooled divider wall 19 becomes fully solid, but at a temperature that remains only slightly below the solidus temperature of the metal concerned. This surface is contacted with the molten metal 23 of the core layer 12 somewhat below the lower end of the divider wall 19, and heat from the molten metal of the core raises the temperature of the solid surface 28 of the cladding layer at positions of first contact. This causes the metal in a shallow region 29 at the metal surface 28 to become "mushy" as its temperature is raised to a level between the solidus and liquidus temperatures of the cladding metal. The region 29 of the cladding layer remains surrounded by solid metal 27.

For reasons that are not presently fully understood, the inventors have found that, when the metals of the core and cladding layers are the same, or have similar coefficients of contraction (e.g. less than 30%, and preferably less than 10%), the cladding layer may bind temporarily against the inner surface 40 of the cooled divider wall instead of flowing smoothly over this surface as the casting proceeds. This effect is perhaps due to contraction forces generated as the metals cool, and is most noticeable at the center of the mold, i.e. the central region between the longitudinal ends of the mold. It has been observed that the downward movement of the cladding layers stops for a brief period of time, and then slips rapidly to make up for the stalled motion. During the time when the cladding layer stops moving, it may be that heat continues to be extracted by the cooled divider wall 19 and the metal at the surface 28 becomes over-cooled. When this over-cooled surface descends and contacts the molten metal 23 of the core ingot, re-heating to form the mushy portion 29 in the cladding layer may not take place at all, or it may be more limited than would otherwise be the case. The desired adhesion produced by the re-heating is therefore reduced or eliminated. This can cause undesirable separation of the layers during subsequent rolling or other treatments of the clad ingot.

It is theorized that the indicated problem is worse at the center of the ingot than at the ends because the molten metal sump of the core layer is deepest at the center of the emerging ingot (where the molten metal is introduced). This significant depth causes greater forces of contraction to develop within the core ingot in this region, thereby pulling the cladding layer in towards the divider wall. As the molten metal solidifies, forces of contraction develop parallel to the solidifying surface. Consequently, when the sump is deep, the length of the solidifying surface between the cladding layer and the ingot center is longer, and the developed force consequently higher than at positions where the sump is shallower.

The exemplary embodiments overcome this problem by tapering or angling the divider walls 19 at the surface 40 that contacts the metal of the cladding layer(s). This means that the surface 40 of the divider wall 19 that contacts and restrains the metal of the outer or cladding layer is arranged at an angle sloping away from the metal for the outer layer (i.e. sloped inwardly towards the core layer) in the direction from top to bottom of the divider wall. The angle of slope is made relatively high in the central region of the mold and is decreased between the center and the longitudinal ends of the mold. The angle of taper minimizes the contact and forces exerted between the metal of the cladding layer and the surface of the divider wall. The angle of taper is preferably chosen to optimize the reduction of forces (and hence to minimize the likelihood of binding or snagging of the metal during casting) while still maintaining sufficient contact for proper guidance and cooling of the metal. For example, in casting apparatus of the type shown in FIG. 1, the divider wall 19 may be tapered or angled from the vertical by an angle that is preferably in the range of 1 to 10°, and more preferably 3 to 7°, at the center of the mold, but is reduced to less than 3°, and more preferably less than 2°, or even less than 1°, at or adjacent to the longitudinal ends of the mold where contraction forces are believed to be less. The angles actually selected may depend on the relative coefficients of contraction of the metal of the inner and outer layers in any particular case.

The increase in taper of the divider walls towards their respective centers is illustrated schematically in FIGS. 3A to 3D, in which the angle of taper at the center is represented as angle θ, and the angle of taper at or adjacent to the longitudinal ends is represented by angle θ'. The angle θ at the center is preferably at least twice the angle θ' at the ends, but this may depend on the particular alloys employed. Any degree of increase in the angle of taper towards the center of the divider wall is often found to be beneficial, but the preferred doubling or more gives significant improvements. The most preferred angle for any particular set of circumstances can easily be determined empirically by carrying out test casting operations using different angles and observing the results. Of course, it will be realized that an angling of the surface of the divider wall is only needed in the region where the surface contacts the metal of the outer layer of the ingot, i.e. towards the bottom end of the divider wall, but the entire surface may be angled for simplicity of manufacture or operation.

Figure 4:
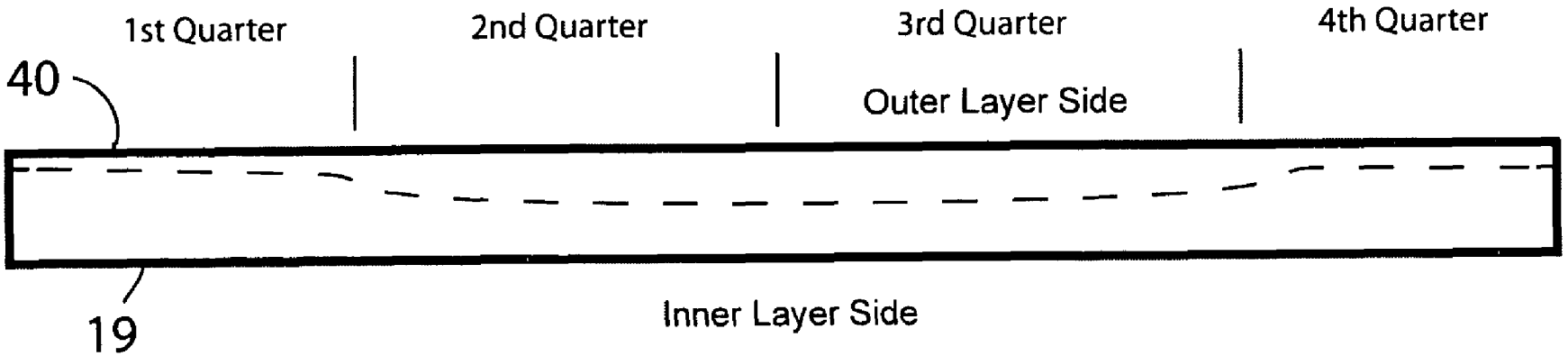
FIG. 4 is an alternative example of a divider wall configured according to an exemplary embodiment of the present invention.

The increase in angle of taper of the surface 40 of divider wall 19 towards the center may take place gradually and linearly along the length of the divider wall from the center to the longitudinal ends. However, it is not always necessary to increase the angle of taper in this way. In another exemplary embodiment, the angle of taper at the ends of the divider wall remain constant for a certain distance and then increase to an angle suitable for the central region. The positions where the angle of taper increases (or starts to increase) on each side inwardly from the ends may be taken as approximately the quarter points of the ingot length. That is to say, a central region of constant (maximum) taper extends across the central region (the second and third quarters) to approximately the quarter and three quarter points along the divider wall, and then the angle of taper decrease (and may then remain constant) in the more distant first and fourth quarters. A divider wall tapered in this way is shown in FIG. 4. A possible reason for this can be explained with reference to FIG. 5.

Figure 5:
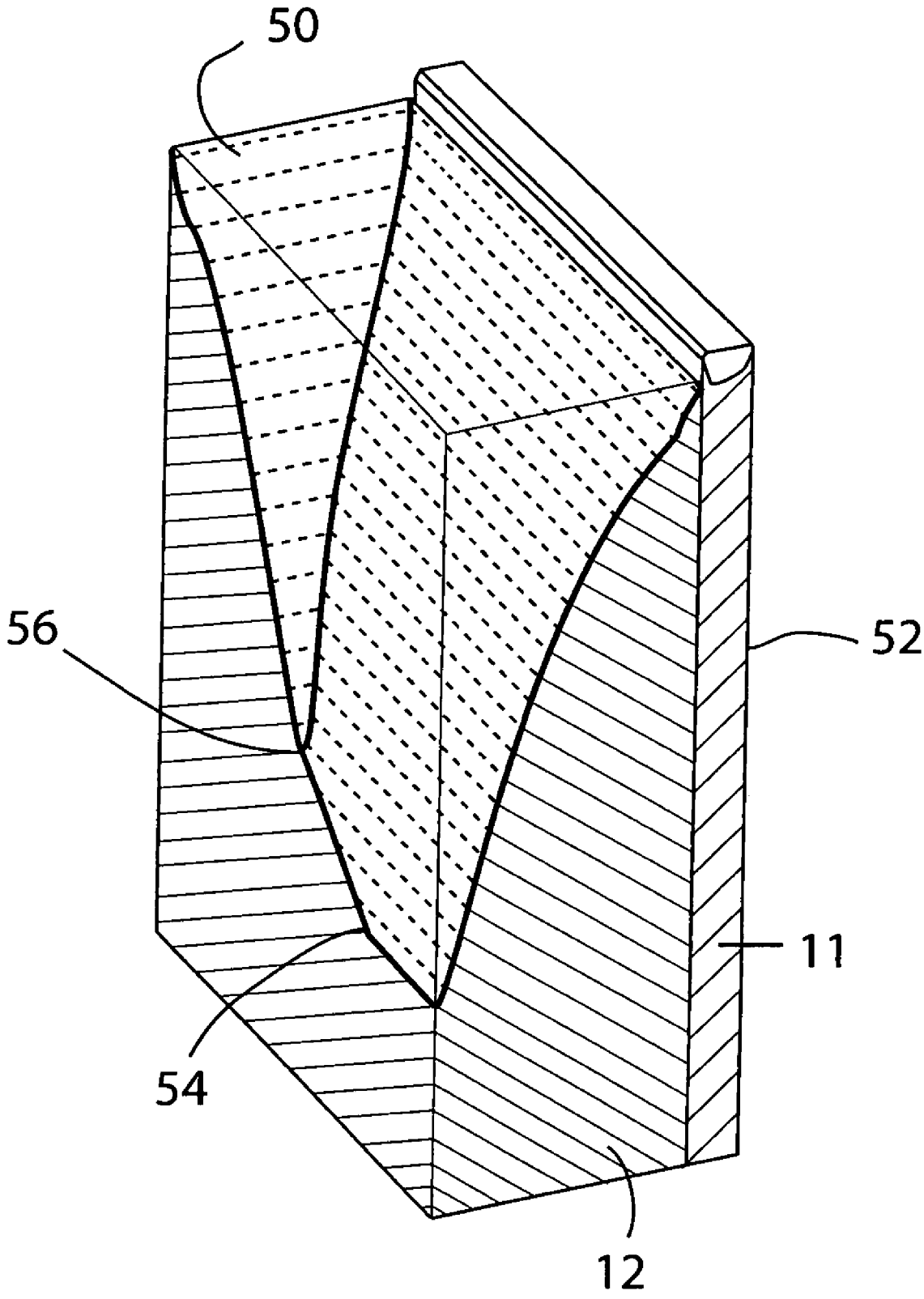
FIG. 5 is a representation of one end of an ingot being cast in the apparatus of a type shown in FIG. 1 (viewed as a vertical section along the centerline of the ingot); the figure shows the depth of a sump of the molten metal at positions approaching an end surface of the ingot.

FIG. 5 of is a representation of an end region of an ingot as it is being cast, taken along a vertical section at the center line (referred to as the thermal shed plane). In this view, the casting apparatus is omitted and only the cast metal is shown. The molten metal is shown as transparent for reasons of clarity, whereas solid metal is represented by cross-hatching. The surfaces (shown in broken lines) represent the transitions from molten metal to solid (the semi-solid regions being omitted for simplicity). Cooling takes place from the end surface 50 of the ingot as well as the side surface 52, so the sump of molten metal becomes progressively more shallow as it approaches the end surface 50. There is usually a point 54 (often around the quarter or three-quarter position along the ingot) where the bottom of the sump angles upwardly at a steep rate, and then a further point 56 where the bottom of the sump becomes even steeper, and there is generally a bifurcation as the sump walls parallel to the end surface and the side surface meet. On the other side of point 54 towards the center of the ingot where the molten metal is introduced, the bottom of the sump remains generally horizontal or varies only at a shallow angle, until a point equivalent to 54 is encountered at the opposite side of the ingot. In such a case, the contraction forces acting on the ingot and cladding layer diminish as the end 50 is approached, starting at the points where the sump becomes less shallow. This is because contraction forces diminish as the depth of the sump decreases. The angle of taper of the corresponding divider wall may remain constant (and highest) in the central region of the ingot where the sump is deepest and the bottom is generally horizontal, and changes (becoming tapered at a lesser angle) adjacent to the point 54, or possibly the point 56. The angles of taper may change abruptly over a short distance, or gradually towards the end surface of the ingot. The change in taper may exactly match the change of sump depth at positions along the ingot (i.e. the angle of taper decreases from the center to the end of the ingot proportionally to the depth of the sump), but this may be difficult to achieve in practice and is not generally necessary. An approximation will normally suffice as it may be difficult to determine the exact contour of the bottom of the sump as an ingot is being cast.

As well as being tapered at an increasing angle towards its center, divider wall 19 may also be arched outwardly (in the manner shown in FIG. 7 of U.S. patent application Serial No. 2005/0011630) to accommodate contraction of the long side faces of the ingot during cooling and solidification. This will compensate for the "bowing-in" of these faces and produce side surfaces closer to the ideal planar shape that is desirable for rolling into sheet articles.

Although not shown in the drawings, the inner casting surfaces of the long mold walls 14 may be vertical or may themselves be tapered, i.e. sloping outwardly towards the bottom of the mold (in which case the angle of taper would normally be up to about 1°). When a taper of this kind is employed for the mold wall 11, however, it is generally kept the same for the entire length of the mold wall.

Figure 6:
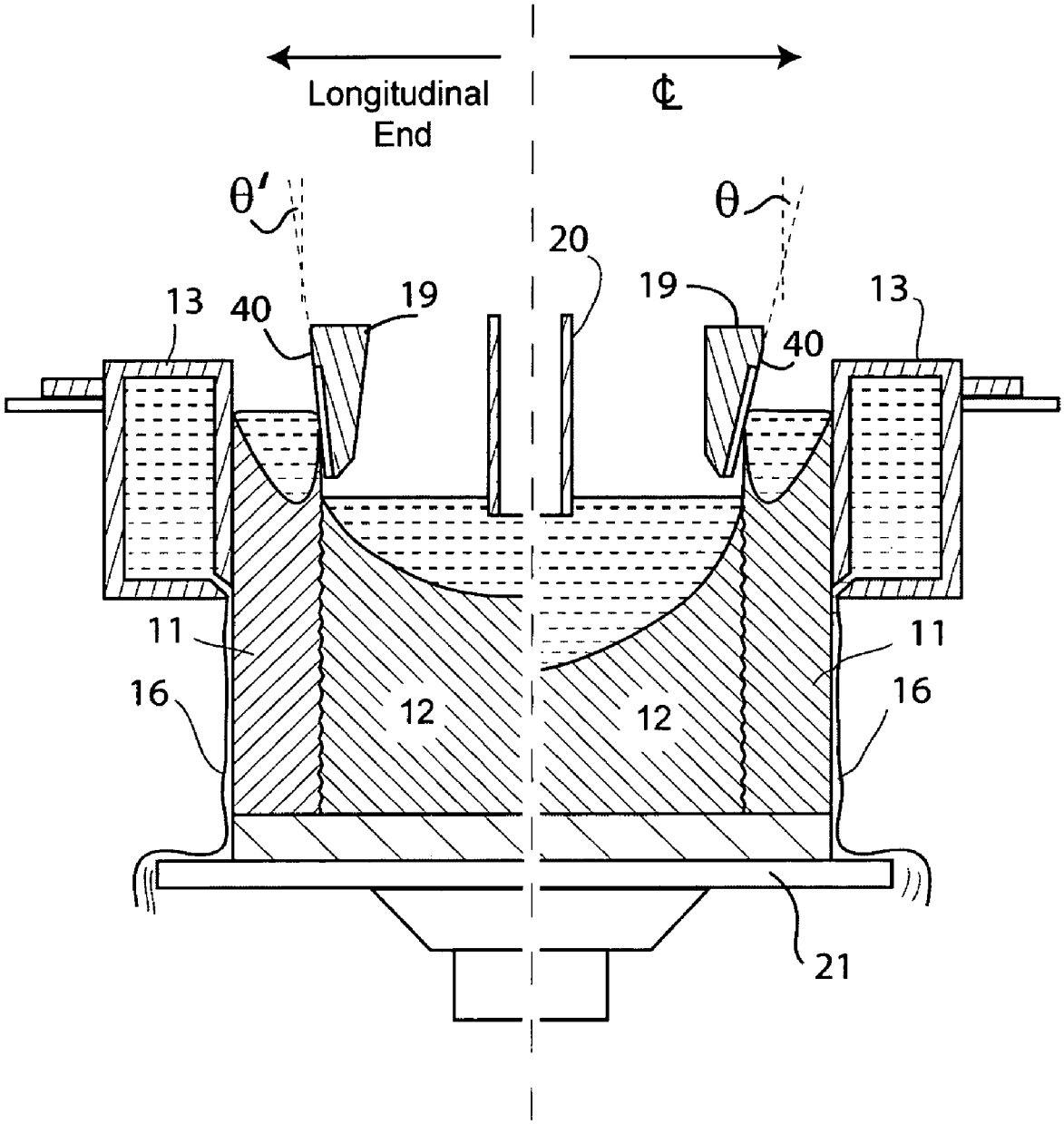
FIG. 6 is a split vertical cross-section of a casting apparatus, somewhat similar to that shown in FIG. 1, but configured according to one exemplary embodiment of the present invention, showing a partial cross-section adjacent to one longitudinal end of the ingot and a second partial cross-section at the center of the ingot.

FIG. 6 is a view similar to that of FIG. 1 showing a casting apparatus according to one exemplary embodiment of the invention. The figure is split vertically down the center of the casting apparatus. The right hand side shows the apparatus in vertical cross-section at the longitudinal center point of the ingot, and the left hand side shows the casting mold at a position towards one longitudinal end of the ingot. The two halves of the drawing show the different angles (θ and θ') of divider walls 19 at these different positions as well as the variation in the height of the central solidification point of the metal of the inner layer at these points. It will be seen that the angle of taper θ' towards the end of the ingot is much less than at the center (angle θ).

The present invention may be of particular benefit when co-casting the following alloy combinations. It will be appreciated that these alloy combinations are provided as examples only, and that the co-casting of other alloy combinations may also benefit from the invention. In the following alloy combinations, the AA identification numbers are used to identify the compositions of the alloys and the alloy of the cladding is given first:

3003/3104

6063/6111 and

5005/5052.

The above description refers to the formation of a rectangular ingot, but a similar variation of taper may be employed for any clad shape where a reduction of adhesion at the center of the ingot is encountered. In general, the invention is effective when the cladding layer(s) is (are) cast first.

What we claim is:

1. Apparatus for casting a composite metal ingot, comprising:

an open-ended generally rectangular mold cavity having an entry end portion, a discharge end opening, and a movable bottom block adapted to fit within the discharge end and to move axially of the mold during casting;

at least one cooled divider wall at the entry end portion of the mold to divide the entry end portion into at least two feed chambers; and a feeder for feeding metal for an inner layer to one of said at least two feed chambers and at least one additional feeder for feeding metal for at least one outer layer to at least one other of said feed chambers;

wherein said at least one divider wall has a metal-contacting surface in use contacting said metal of said at least one outer layer, said surface being arranged at an angle sloping towards the mold center and sloping away from said metal of said outer layer in a direction of metal flow through said mold, said angle being larger at a center of said at least one divider wall than at positions adjacent to longitudinal ends of said at least one divider wall.

2. The apparatus of claim 1, wherein said at least one additional feeder is positioned to introduce said metal for said outer layer into said mold at a position in said mold closer to said entry end portion of the mold than said feeder for feeding said metal for said inner layer.

3. The apparatus of claim 1, wherein said angle of said surface of said at least one divider wall at said center is at least double said angle at said positions adjacent to said longitudinal ends thereof.

4. The apparatus of claim 1, wherein said angle of said at least one divider wall is at least 3° at said center and no more than 2° at positions adjacent to said longitudinal ends thereof.

5. The apparatus of claim 1, wherein said angle of said at least one divider wall is in a range of 3 to 7° at said center and in a range of 1 to 2° at positions adjacent to said longitudinal ends thereof.

6. The apparatus of claim 1, wherein said at least one divider wall has an elongated central region, and wherein said angle remains constant within said central region and then decreases beyond said central region to said positions adjacent to said longitudinal ends.

7. The apparatus of claim 1, wherein, in use, said inner layer has a molten metal sump having variations in depth from one longitudinal end of said layer to another longitudinal end, and wherein variations of said angle of said surface of said at least one divider wall take place at positions that correspond to significant variations of depth of said sump.

8. The apparatus of claim 1, wherein variations of said angle of said surface of said at least one divider wall take place gradually and linearly between said longitudinal ends thereof.

9. The apparatus of claim 1, wherein variations of said angle of taper of said surface of said at least one divider wall take place at approximately quarter points and three-quarter points along said divider wall.

* * * * *